United States Patent [19]

Harimoto et al.

[11] 4,049,527

[45] Sept. 20, 1977

[54] ELECTRODEPOSITED METAL PLATE PEELING-OFF MACHINE

[75] Inventors: Takeshi Harimoto; Keisuke Nishiyama, both of Shimonoseki, Japan

[73] Assignee: Mitsui Mining & Smelting Co., Ltd., Tokyo, Japan

[21] Appl. No.: 756,187

[22] Filed: Jan. 3, 1977

[30] Foreign Application Priority Data

| | | |
|---|---|---|
| Jan. 8, 1976 | Japan | 51-1879 |
| Jan. 8, 1976 | Japan | 51-1880 |

[51] Int. Cl.[2] ..... C25C 7/08; C25D 1/20

[52] U.S. Cl. ..... 204/198; 204/281

[58] Field of Search ..... 204/198, 194, 281, 208, 204/226, 12

[56] References Cited

U.S. PATENT DOCUMENTS

| | | | |
|---|---|---|---|
| 3,636,677 | 1/1972 | McNamara et al. | 204/12 |
| 3,883,403 | 5/1975 | Ettel | 204/12 |
| 3,953,312 | 4/1976 | Kikkawa et al. | 204/198 |
| 3,996,127 | 12/1976 | Rautimo | 204/281 |

*Primary Examiner*—T. M. Tufariello

*Attorney, Agent, or Firm*—Blanchard, Flynn, Thiel, Boutell & Tanis

[57] ABSTRACT

The electrodeposited metal plate peeling off machine according to the present invention comprises a hammering apparatus, a peeling off apparatus and a transfer means installed throughout the foregoing two apparatuses for the purpose of intermittently transferring a cathode plate composed of the electrodeposited metal plates and the base plate holding said electrodeposited metal plates thereon from the hammering apparatus to the peeling off apparatus, wherein the hammering apparatus consists of hammering means, accommodated in a sound insulating box of closed type construction employing sound insulating materials and the peeling off apparatus is equipped with nozzle pipe having a slit-like nozzle, respectively, which is directed to the upper edge of the electrodeposited metal plate and disposed practically parallel to said upper edge at an appropriate distance, blowers for continuously supplying low-pressure air to said nozzle pipes, and roller conveyers disposed below the peeling off means and composed of rollers having their covering material backed with soft-rubber lining.

3 Claims, 15 Drawing Figures

ELECTRODEPOSITED METAL PLATE PEELING-OFF MACHINE

BACKGROUND OF THE INVENTION

The present invention relates to a machine for the purpose of automatically peeling the metal plates off the base plate with respect to a cathode plate composed of the cathode's base plate (hereinafter simply called 'base plate') and the electrodeposited metal plates (hereinafter simply called 'metal plates') attached to both faces of said base plate in the metal recovering process in electrolytic metal refinery.

There has already been filed an application for U.S. Patent with respect to a peeling off machine for the purpose of peeling metal plates off its base plate, which is devised such that, on the occasion of forming a fine gap in between the base plate and the metal plate by subjecting the surface of the upper edge of metal plate to hammering process beforehand and thereafter driving a wedge into said fine gap thereby to peel off the metal plate, a low-pressure fluid is jetted toward the fine gap from the vicinity of the edge of said wedge prior to driving it in thereby to float the metal plate off the base plate and form a gap sufficient for driving in a wedge (See U.S. Patent Application Ser. No. 487,204 filed July 10, 1974).

However, this previously invented peeling off machine is attended with such a drawback that, inasmuch as the entirety of the hammering apparatus assigned for the hammering work on the surface of the upper edge of metal plate is usually left in non-covered state, at the time when the hammering process is carried out, the apparatus makes a noise, and also on the occasion of jetting air current of low pressure in the range of about 1-3 $Kg/cm^2$ into the fine gap formed in between the base plate and the metal plate subsequent thereto, due to the employment of a compressor in generating such a pressure air and a nozzle in jetting said pressure air onto the metal plate, a noise arising from the operation of the compressor and a noise arising from the spotwise impact of the pressure air on the metal plate come to be combined with the noise arising from said hammering process to bring on such a huge noise as reaching 103 phons in the workshop.

SUMMARY OF THE INVENTION

In view of the foregoing defect in the prior art, one object of the present invention is to provide an electrodeposited metal plate peeling off machine which will overcome said defect.

Another object of the present invention is to provide an electrodeposited metal plate peeling off machine comprising a hammering apparatus, a peeling off apparatus and a transfer means, wherein the hammering means of said hammering apparatus is accommodated in a sound insulating box, the nozzle pipes of said peeling off apparatus are respectively provided with a slit-like nozzle which is directed to the upper edge of the metal-plate-to-be-peeled-off and disposed practically parallel with said upper edge of metal plate and blowers for continuously supplying low-pressure air to said nozzle pipes are provided, whereby a noise arising from the hammering process can be arrested and a noise ascribable to the source of air supply in the subsequent peeling off process as well as a noise arising from the impact of jetting air on the metal plate can be abated, resulting in much decrease in noise as a whole and a remarkable improvement of working environment.

A further object of the present invention is to provide an electrodeposited metal plate peeling off machine, wherein said hammering apparatus is devised such that, confronting two side walls of the box-shaped casing body formed of sound insulating materials for accommodating hammering means thereof are respectively provided with a slit to face each other for the purpose of letting an upright cathode plate pass therethrough, a transport member is installed penetrating the lower part of both slits for the purpose of conveying said cathode plate so as to move intermittently, guide members are installed penetrating the upper part of both slits and practically parallel with said transport member for the purpose of guiding the cathode plate, and hammer members are installed in the upper part of the interior of the box-shaped casing body for the purpose of performing hammering work on the upper edge portion of the metal plates at the time when the cathode plate in conveyance along the guide members by means of said transport member comes to a halt in the box-shaped casing body, whereby a noise attributable to the hammering apparatus can be minimized.

A still further object of the present invention is to provide an electrodeposited metal plate peeling off machine, wherein the interior of the roller-covering material for the roller conveyors installed below the peeling off means is lined with soft rubber stuck thereto, and a sound arresting member extending outward from the lower end of the roller conveyer is installed on the frame, whereby the impact sound of metal plates falling from the peeling off means on the temporary receiver can be abated.

DETAILED DESCRIPTION OF THE INVENTION

Figure 1:
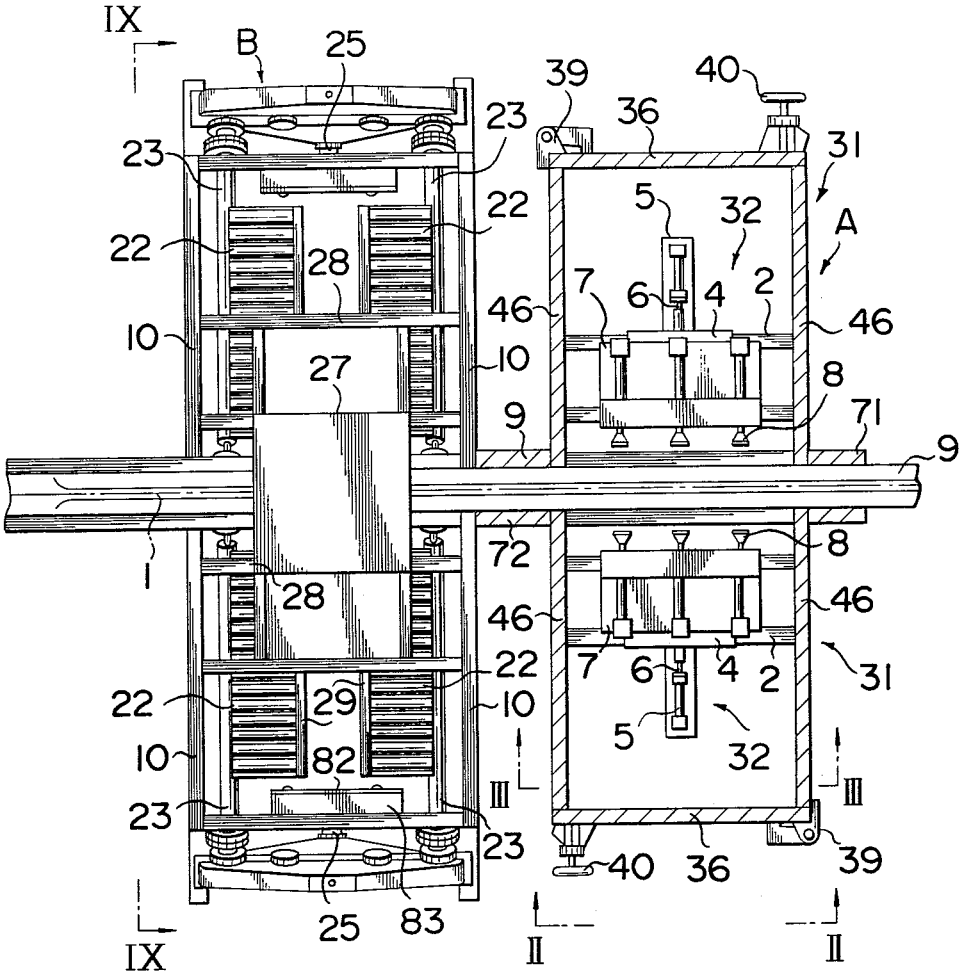
FIG. 1 is a plan view, partly in section, of a hammering apparatus embodying the present invention.

Details of the present invention will be explained hereunder with reference to the embodiment shown in the appended drawings.

The present peeling off machine is broadly divided into the hammering apparatus A and the peeling off apparatus B, and these two apparatuses are juxtaposed with a chain conveyer 1 interposed therebetween which is to be actuated intermittently by a motor not shown in the drawings.

Hammering apparatus A:

In the drawings, the reference numeral 31 denotes a pair of sound insulating boxes, in which the air hammer means 32 is provided. This air hammer means 32 is supported on the support plates 4 which are horizontally installed facing each other with a cathode plate *p* between on the frame 2. On the support plate 4 is installed the cylinder 5, and onto the tip of the actuating rod 6 of the cylinder 5 is connected the slide plate 7 which slides the support plate 4. And, on the slide plate 7 are installed several air hammers 8.

Particulars of the sound insulating box 31 are shown in FIGS. 4–8: the frame is formed of angles-shaped materials, and by fixing varieties of sound insulating materials to this frame, the box is constructed. Both boxes 31 are of closed type excepting that the portion facing the passage for the cathode plate *p* is left open, and they are installed leaving a prescribed space between their openings.

The top wall 33 of each sound insulating box 31 is constructed by filling up angle-shaped steel materials with glass wool 34, and it center is provided with an opening for the purpose of taking in and out the air hammer means 32, said opening being provided with a cover 35. Further, the back wall 36 is constructed by filling up angle-shaped steel materials with glass wool 37, and its center is provided with an opening to serve as an entrance and exit for the working personnel inspecting the air hammer means 32, said opening being provided with a cover 38 whose one side is pivotally supported on the box 31 by means of hinges 39 while the opposite side is provided with handles 40. By the operation of said handles 40, the cover 38 is supposed to be engaged with or disengaged from the engaging members 41 of the box 31. On the top of the space between the two boxes 31 is provided a cover 42 thereby to prevent the leakage of a noise from this space to the outside.

Figure 5:
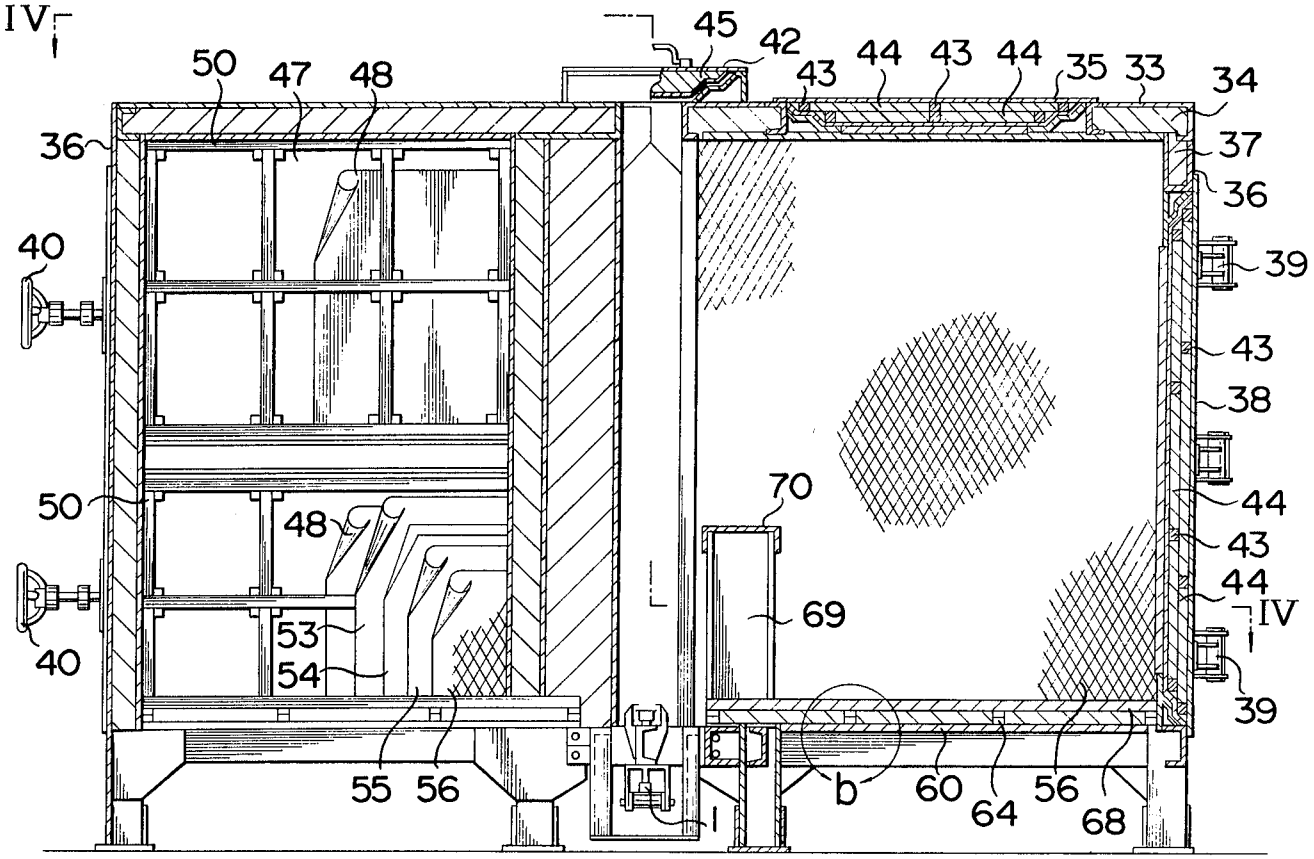
FIG. 5 is a cross-sectional view taken along the line V—V in FIG. 4.

The covers 35 and 38 are, as shown in FIG. 5, composed of a hollow body consisting of steel plates, and this hollow body contains a couple of latticed wooden frames 43 as stratified. The voids of the lattice of each wooden frame 43 are packed with glass wool 44. And, the cover 42 is composed of a hollow body consisting of steel plates and packed with glass wool 45.

Figure 6:
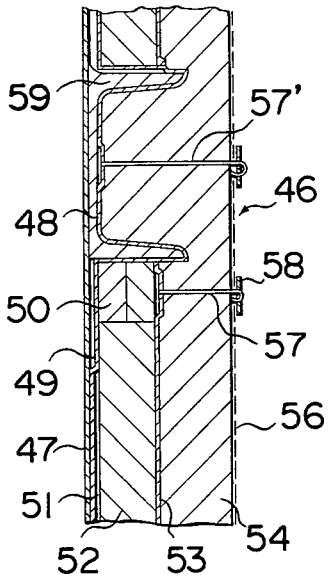
FIG. 6 is an enlarged view of the portion-*a* in FIG. 4.

The both side walls 46 are of such construction as partially shown on an enlarged scale in FIG. 6, wherein 47 denotes a steel plate, on whose back is attached a lead plate 48. Between said lead plate 48 and steel plate 47 is partially provided a rubber plate 49, and the both sides of said rubber plates 49 are stuck to the confronting material. On the back of the lead plate 48 is fixed a latticed wooden frame 50, and a void partially provided in between said wooden frame 50 and lead plate 48 is filled with a rubber plate 51. The voids of lattice of the wooden frame 50 are packed with glass wool 52, and a lead plate 53 covers the thus packed wooden frame 50. On the lead plate 53 are further stratified a glass wool mat 54, a ployethylene film 55 and a polyethylene net 56 in order, and said net 56 is settled by means of set nails 57, whose leg is stuck to a piece of wood, with the help of the washer 58.

The angle-shaped steel material 59 elected in the fore part of the side wall 47 and covered with the external plate 47 has its external surface excepting the portion coming in contact with the external steel plate 47 covered with the lead plate 48, and the set nails 57' whose leg is stuck to a portion of the lead plate 48 are provided to fill the same function as that of the foregoing set nails 57.

Figure 7:
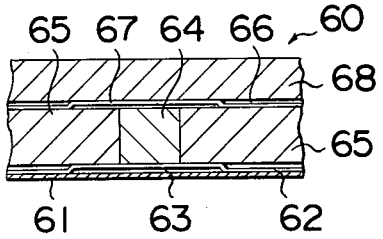
FIG. 7 is an enlarged view of the portion-*b* in FIG. 5.

In FIG. 7 is shown a part of the bottom wall 60 on an enlarged scale. In this FIG. 7, 61 denotes an external steel plate, and on the top face thereof is stuck a lead plate 62. Between said lead plate 62 and external steel plate 61 are partially provided voids, and a rubber plate 63 is provided in each void and both sides of said rubber plate 63 are respectively stuck to the confronting material. On the top face of the lead plate 62 is laid a latticed wooden frame 64 which is stuck to a part of the lead plate 62. Voids of the lattice of the wooden frame 64 are packed with glass wool 65, and another lead plate 66 covers the thus packed latticed wooden frame 64. Between the lead plate 66 and the wooden frame 64 are partially provided voids, and a rubber plate 67 is provided in each void and the both sides of said rubber plate 67 are respectively stuck to the confronting material. On the top face of the lead plate 66 is laid a wooden floor 68, and a part of said wooden floor 68 is stuck to the top face of the lead plate 66. On one side of the thus constructed bottom wall 60 are installed a pair of legs 69 for the sake of installing a stopper for the purpose of stopping the crossfeed of cathode plate *p*, and between these legs 69 is provided the base plate 70 to be put on them.

Figure 8:
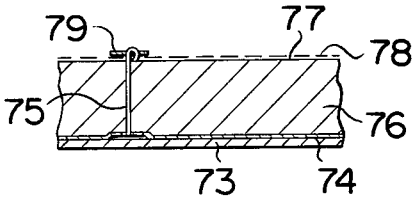
FIG. 8 is an enlarged view of the portion-*c* in FIG. 4.

The fore parts of confronting side walls 46 of both boxes 31 are interconnected by means of the gate-type tunnel walls 71 and 72: shown in FIG. 8 is a part of said tunnel wall on an enlarged scale. In FIG. 8, 73 denotes an external steel plate, and a lead plate 74 is stuck on the back thereof. Between said lead plate 74 and external steel plate 73 are partially provided voids where the leg of set nail 75 is stuck to. This set nail 75 penetrates a glass mat 76, a polyethylene film 77 and a polyethylene net 78 stratified in this order on the lead plate 74 and is settled with the help of the washer 79.

Figure 9:
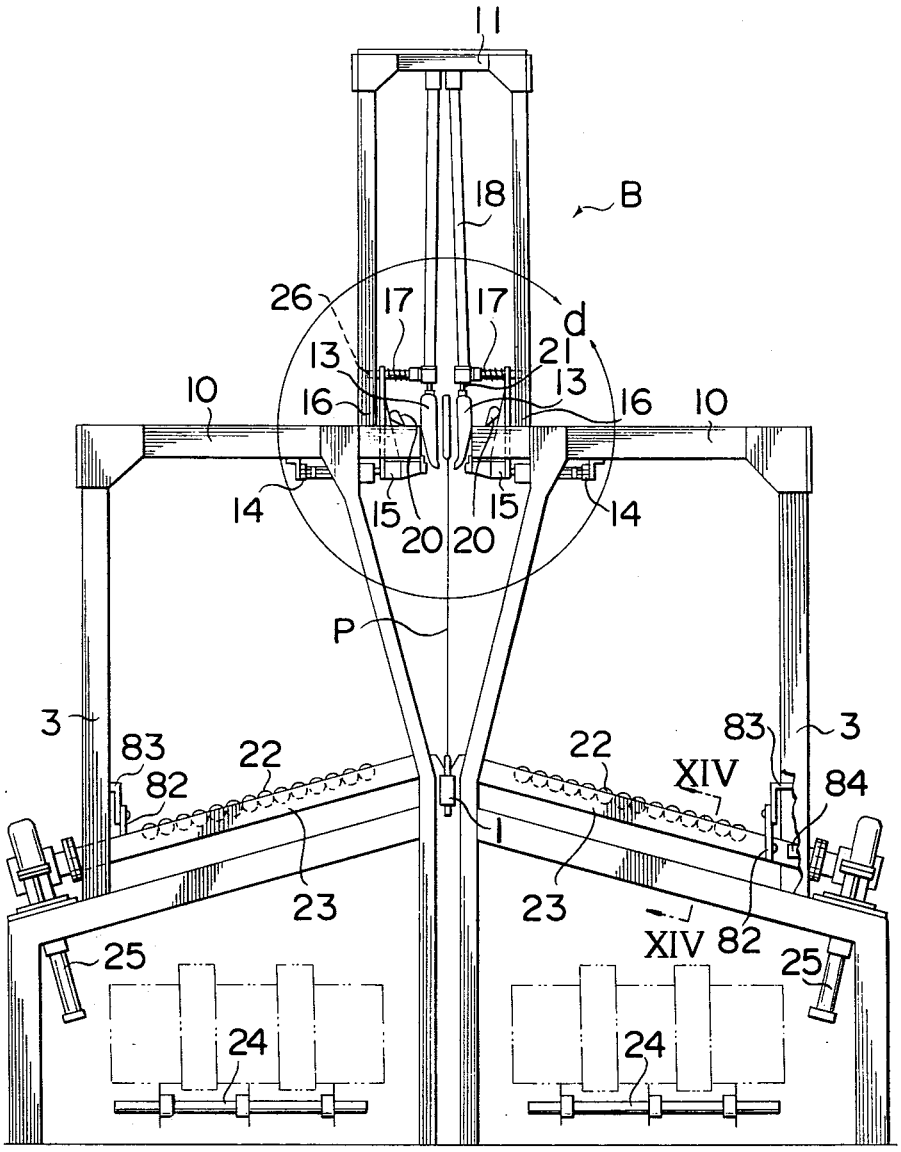
FIG. 9 is a side view taken along the line IX—IX in FIG. 1.

Peeling off apparatus B:

In FIGS. 9 through 15 are illustrated particulars of the peeling off apparatus B. In FIG. 9, a scaffold-like support frame is installed on a beam member stretched on a transverse member 10 of the frame 3, and on the back of the top plate 11 are pivotally supported the bases of a pair of inverted cylinders 18. On the lower end of the rod 21 of each cylinder 18 is equipped a wedge 13 to be disposed on both sides of the cathode plate *p*.

Figure 10:
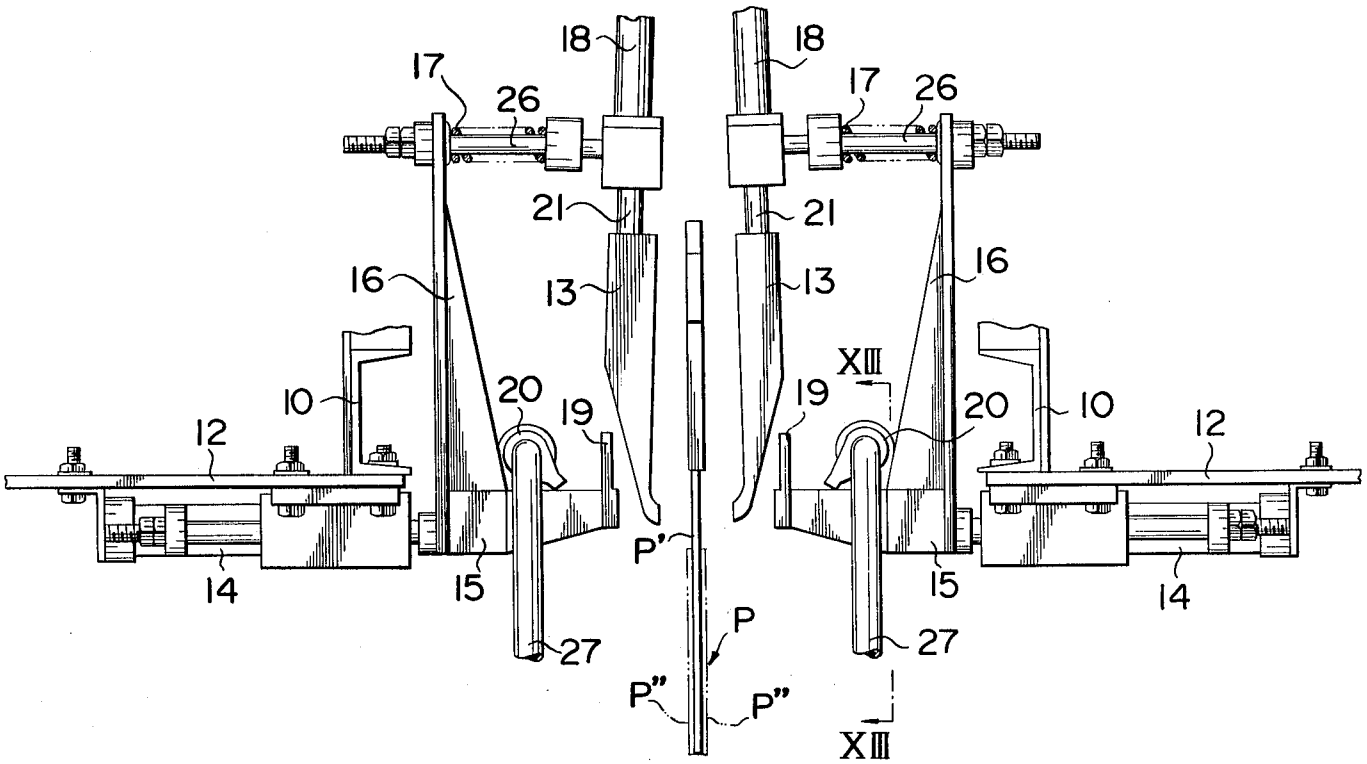
FIG. 10 is an enlarged view of the portion-*d* in FIG. 9.
Figure 11:
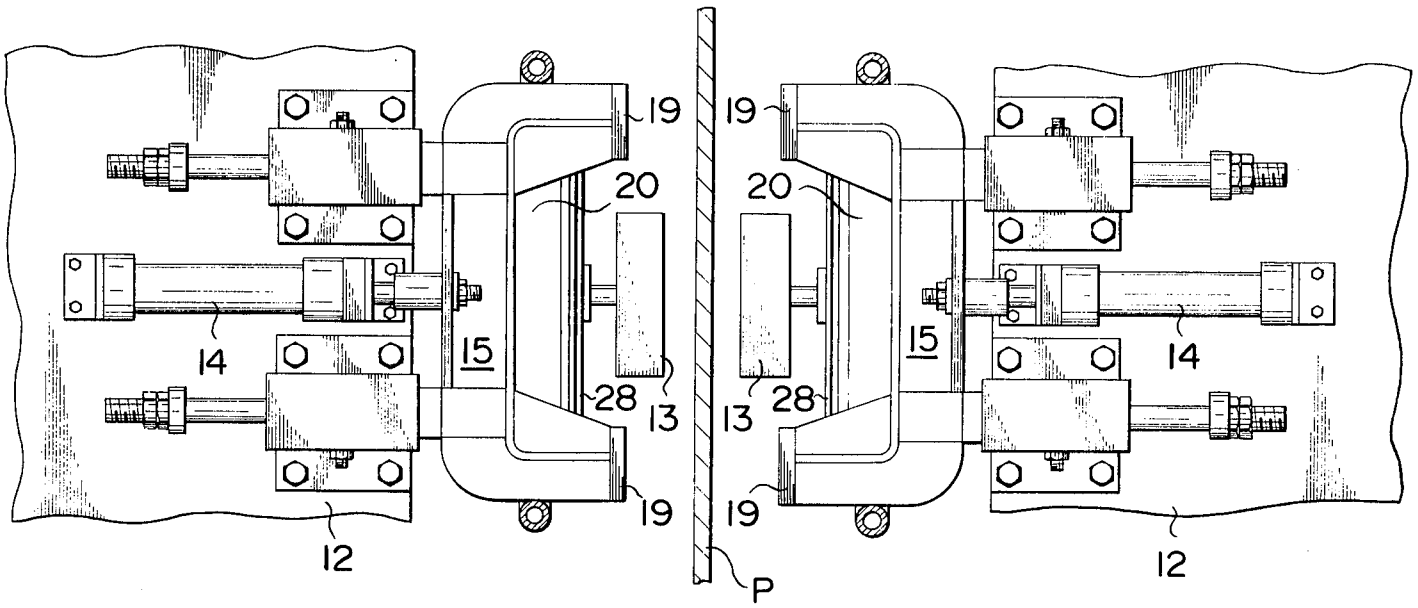
FIG. 11 is a plan view of the same portion as in FIG. 10 as viewed from the bottom thereof.

Referring to FIGS. 10 and 11, a support plate 12 is fixed to each transverse member 10. On the lower side of this support plate 12 is fixed a cylinder 14, and on the tip of the actuating rod of this cylinder 14 is fixed a clamp body 15. Further, on the tip of each clamp body 15 is fixed a clamp plate 19 which constitutes a pair of clamp plates facing each other.

Figure 12:
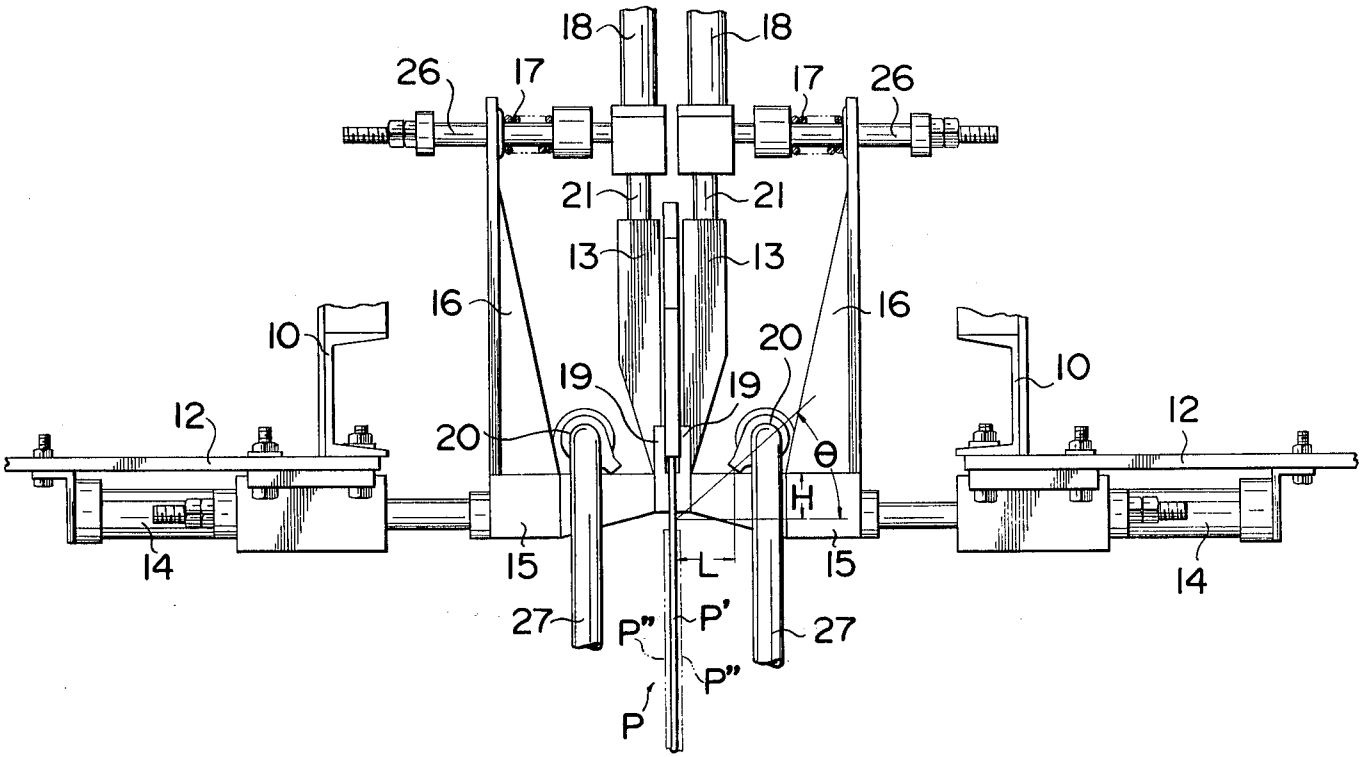
FIG. 12 is illustrative of the mode of operation of the same portion as in FIG. 10.
Figure 13:
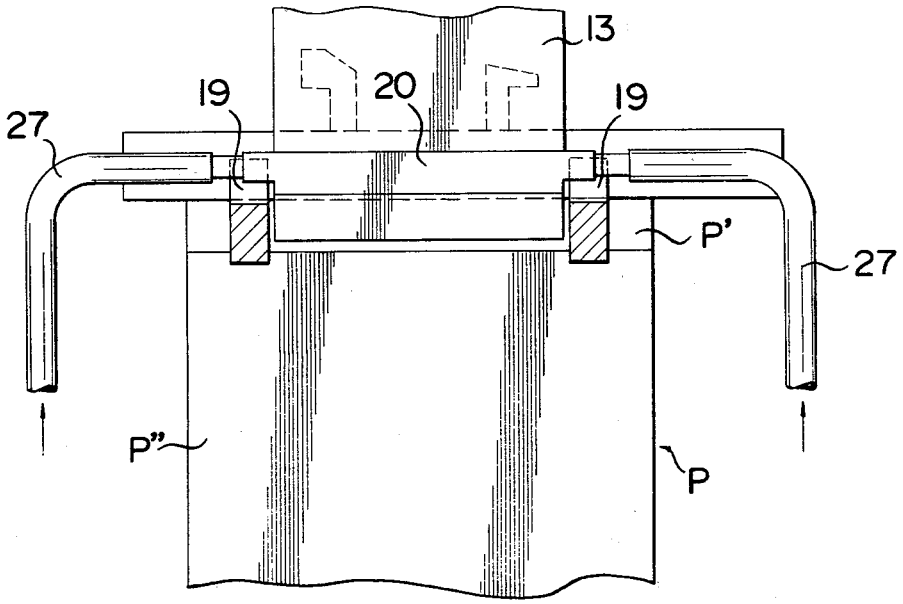
FIG. 13 is a cross-sectional view taken along the line XIII—XIII in FIG. 10.

On the top of each clamp body 15 is installed a downward nozzle pipe 20 equipped with a slit-like nozzle 28 for jetting a gas toward around the upper edge of the joint of base plate $p'$, and metal plate $p''$ whenever the clamp bodies 17 clamp the upper part of cathode plate $p$ as shown in FIG. 12. The angle $\theta$ of this nozzle 28 relative to the horizontal level is determined in the range of 0°-60° depending on such conditions as the size of nozzle pipe 20, the pressure of gas to be jetted, etc.: the optimum angle is 30°. The distance L between the nozzle 28 and the base plate $p'$ *is set at* 30 mm-100 mm according to the foregoing conditions. The height H of the nozzle 28 is preferably 50 mm, the length of the nozzle 28 is preferably about ⅔ of the width of the cathode plate $p$ (or about 600 mm) as seen from FIG. 13, and the width thereof is preferably 3 mm or 5 mm. To both sides of the nozzle pipe 20 is connected a flexible pipe 27 for supplying air, said flexible pipe 27 being further connected to a blower not shown in the drawing. In this connection, as the result of experiments, it has been found that the optimum capacity of the blower is 3 $m^3$/min × 700 mm Aq × 3.7 KW.

On the top of each clamp body 15 is further installed an arm 16, in which a rod 26 which is fixed on the lower part of the cylinder 18 is slidingly fit with the aid of resilience of a spring 17.

Figure 14:
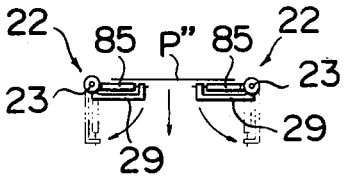
FIG. 14 is a cross-sectional view taken along the line XIV—XIV in FIG. 9.
Figure 15:
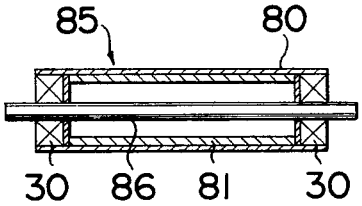
FIG. 15 is a cross-sectional view — on an enlarged scale — of the roller in FIG. 14.

Below the frame 3 and on both sides of the conveyer 1, there are bilaterally installed roller conveyers 22 which are inclined downward in the direction of parting from the conveyer 1. The respective roller conveyer 22 is, as illustrated in FIGS. 1 and 14, installed in a cantilever-fashion on a shaft 23 as pivotally supported on the frame 3 and consists of a multiplicity of rollers 85 as pivotally supported on a bracket 29 formed in the space between the confronting shafts 23. The shafts 23 are interconnected by means of the cylinder 25 illustrated in FIGS. 1 and 9 together with other appropriate means whereby they are supposed to be simultaneously shifted between the position expressed by the solid line and the position expressed by the dotted line in FIG. 14. The roller 85 is, as illustrated in FIG. 15, composed of a central shaft 86 and a steel pipe 80 covering it with the aid of bearings 30. On the inside of said steel pipe 80 is stuck a soft-rubber lining 81. Stopper plates 82 consisting of urethane plate as disposed outside the lower end of the roller conveyer 22 as shown in FIGS. 1 and 9 are fixed to the frame 3 through a bracket 83 respectively, and on the back of this stopper plate 82 is provided the limit switch 84. 24 denotes a conveyor, which is disposed below the roller conveyor 22 for the purpose of receiving metal plates $p''$ to be discharged from the roller conveyor 22.

Figure 2:
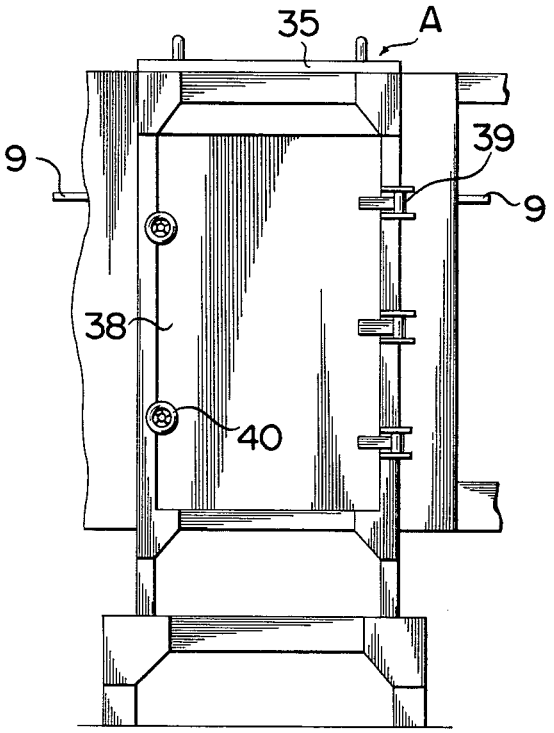
FIG. 2 is a front view taken along the line II—II in FIG. 1.
Figure 3:
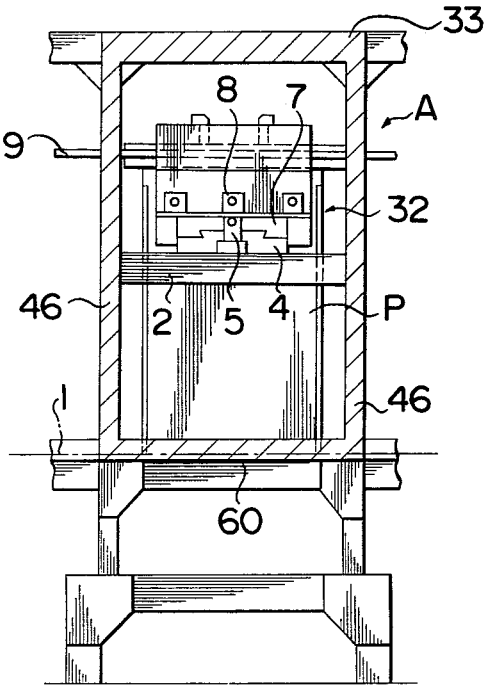
FIG. 3 is a cross-sectional view taken along the line III—III in FIG. 1.
Figure 4:
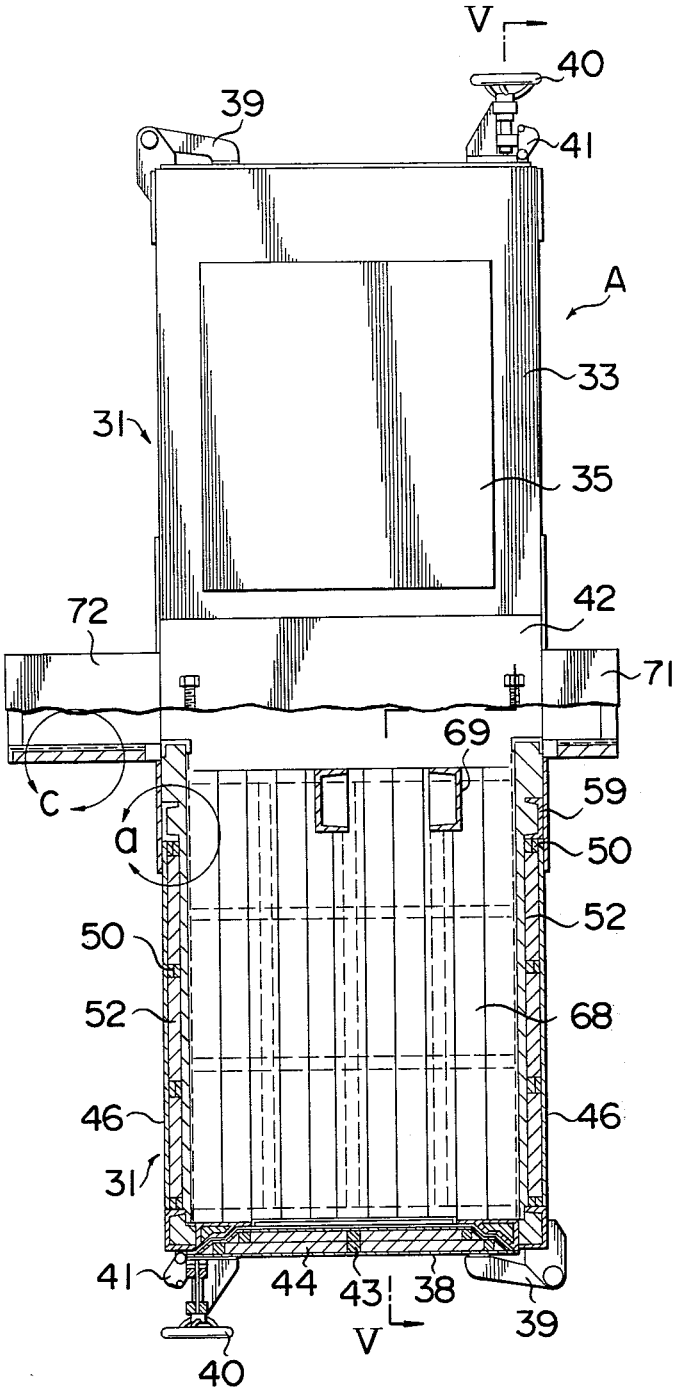
FIG. 4 is a plan view — on an enlarged scale — along the line IV—IV in FIG. 5 wherein the lower half of the sound insulating box of the hammering apparatus in FIG. 1 is shown by cutting.

Mode of operation:

A cathode plate $p$ composed of the base plate $p'$ and the metal plates $p''$ held thereon is shifted intermittently at regular intervals from the right to the left in FIGS. 1 and 2 in the state of having its lower end put on the chain conveyor 1. When it is conveyed into the sound insulating box 31 of the hammering apparatus A and arrives at the air hammer means, 32 therein, it comes to a halt under the direction of a sensing means not shown in the drawings, while the cylinder 5 is actuated to move the air hammer 8 to the vicinity of two sides of the upper part of the cathode plate $p$. At this, the air hammer 8 is actuated to apply intermittent impact on the surface of the upper part of the metal plate $p''$ attached to both faces of the cathode plate $p$, thereby to form a fine gap in between the base plate $p'$ and the metal plate $p''$. After performing this impact process for a fixed time, the air hammer 8 stops working and retreats, and then the chain conveyor 1 is actuated again to shift the cathode plate $p$ transversely to the outside of the sound insulating box 31.

When a cathode plate $p$ thus undergone the impact process arrives at the position for peeling-off work, or a position confronting the wedge 13 of the peeling off apparatus B, it comes to a halt under the direction of a sensing means not shown in the drawings. At the same time, the clamp cylinders 14 are actuated to advance the clamp bodies 15, and simultaneously therewith, the arms 16 erected on the top of the clamp bodies 15 advance the rods 26 inserted in a spring 17 respectively, whereby the lower part of the cylinders 18 as fixed to the fore end of said rod 28 respectively is advanced toward the cathode plate $p$, and the clamp plates 19 of the fore ends of clamp bodies 15 come in contact with the upper edge portion of the cathode plate $p$ to hold said cathode plate between and settle it. The nozzle pipes 20 having slit-like nozzle 28 as disposed in the middle of the clamp plate 19 front on the portion of cathode plate $p$ in the vicinity of the upper edge of the metal plate $p''$ electrodeposited on the base plate $p'$, and the tip of the wedge 13 also comes in touch with the base plate $p'$ or arrives at a position very close to it to be positioned directly above the upper edge of the metal plate $p''$ (See FIG. 12).

From the slit-like nozzle 28 of nozzle pipe 20 is continuously jetted air with a pressure equivalent to 500-1000 mm water column by means of a blower not shown in the drawings at the rate of 0.5-1.5 $m^3$/min toward each metal plate $p''$, and by virtue of the pressure of said jet of air, the upper edge of metal plate $p''$ comes to float off the base plate $p'$. Following the start of the jetting of air, by virtue of the delayed action of the cylinder 18, the actuating rod 21 thereof is pushed forward, the wedge 13 is made to descend along the surface of the base plate $p'$, the edge of the wedge 13 cuts in the gap between the base plate $p'$ and the metal plate $p''$ floated off said base plate $p'$, and with the continuous descent of said wedge the metal plate $p''$ is gradually peeled off the base plate $p'$.

The metal plate $p''$ peeled off the base plate $p'$ fall outward on both sides of the latter and drop on the roller conveyors 22 disposed below. On this occasion, inasmuch as the respective rollers 85 of each roller conveyor 22 are backed with a soft-rubber lining, there is no fear of their making a noise such as in the prior art. A metal plate $p''$ fallen on the conveyor 22 as above moves downward along said conveyor 22 and runs against the stopper plate 82, whereby the limit switch 84 is actuated by this stopper plate 82 and the cylinder 25 is actuated accordingly. On this occassion, inasmuch as the stopper plate 82 consists of urethane plate, there is no fear of its making a noise even when the metal plate $p''$ runs against it. When the cylinder 25 is actuated as above, the shaft 23 rotates, the roller conveyor 22 installed on the shaft 23 turns to a position expressed by the dotted line in FIG. 14, the metal plate $p''$ put on the roller conveyor 22 is let fall on the conveyor 24 disposed below said roller conveyor 22, the roller conveyor 22 is thereafter restored to its initial position, and the metal plate $p''$ is conveyed by the conveyor 24.

When the wedge 13 descends up to the lower edge of the base plate $p'$ and the peeling-off work for the metal plate $p''$ is over, the cylinder 18 works upward, whereby the wedge 13 ascends immediately and comes to a halt upon returning to its initial position. Simultaneously therewith the clamp cylinder 14 works backward, whereby the clamp body 15 is made to retreat, the clamping of the base plate *p'* by the clamp plates 19 is cancelled and, at the same time, the wedge 13 is parted from the surface of base plate *p'* by means of the arms 16 and rods 26.

As will be understood from the foregoing descriptions, according to the present invention, the hammering process making the biggest noise in the peeling-off operation is entirely carried out within a sound insulating box of closed type construction employing sound insulating materials except for the provision of slits constituting the indispensable openings for the purpose of passing cathode plates and therefore said noise is never diffused to other surrounding workshops; and as to the peeling-off process succeeding to the hammering process, unlike the conventional peeling-off process, there is employed a blower instead of a compressor making a noise, whereby a noise arising from the air supply source is controlled and, what is more, inasmuch as the air to be jetted onto the cathode plate is supplied by the blower, it is of by far low pressure compared with that to be supplied by a compressor and its impact on the metal plate is linearly effected; accordingly, the jet impact sound thereof is remarkably abated and, as a whole, a noise in the workshop arising from the conventional peeling off machine — which used to be as big as 103 phons — can be lessened to be as low as 87 phons thereby to improve the working environment markedly.

What is claimed is:

1. In the electrodeposited metal plate peeling off machine equipped with a hammering apparatus, a peeling off apparatus and a transfer means installed throughout the foregoing two apparatuses for the purpose of intermittently transferring a cathode plate composed of the electrodeposited metal plates and the base plate holding said electrodeposited metal plates thereon from the hammering apparatus to the peeling off apparatus, a peeling off machine which is characterized in that said hammering apparatus comprises a hammering means accommodated in a sound insulating box of entirely closed type construction built of sound insulating materials except for the provision of longitudinal slits formed on the confronting two side walls thereof perpendicular to the direction of progress of the transfer means for the purpose of passing cathode plates to be transferred, and said peeling off apparatus is equipped with nozzle pipes having a slit-like nozzle, respectively, fronting on the upper part of the electrodeposited metal plate as a prescribed distance and disposed substantially parallel thereto, coupled with a blower to supply a low-pressure gas to said nozzle pipe continuously.

2. A peeling off machine according to claim 1, wherein said hammering apparatus is devised such that, confronting two side walls of the box-shaped casing body formed of sound insulating materials for accommodating hammering means thereof ar respectively provided with a slit to face each other for the purpose of letting an upright cathode plate with electrodeposited metal plates pass therethrough, a transport member to move intermittently is installed penetrating the lower part of both slits for the purpose of conveying said cathode plate, guide members are installed penetrating the upper part of both slits and practically parallel with said transport member for the purpose of guiding the cathode plate, and hammer members are intstalled in the upper part of the interior of the box-shaped casing body for the purpose of performing hammering work on the upper edge portion of the electrodeposited metal plates at the time when the cathode plate in conveyance along the guide members by means of said transport member comes to a halt in the box-shaped casing body.

3. A peeling off machine according to claim 1, wherein bilateral roller conveyors for the purpose of temporarily receiving electrodeposited metal plates peeled off by said peeling off means are installed beneath the peeling off means by sloping them down toward the frame respectively, a sound arresting member disposed outside the lower end of the respective roller conveyor is installed on the frame, and soft-rubber lining is stuck to the interior of the covering material of each roller of said roller conveyor.

* * * * *